US007550878B2

(12) United States Patent
Komatsu et al.

(10) Patent No.: US 7,550,878 B2
(45) Date of Patent: Jun. 23, 2009

(54) CIRCUIT FOR PREVENTING CORROSION OF CONTACT

(75) Inventors: Kazuhiro Komatsu, Hyogo (JP); Masahiko Fujimoto, Hyogo (JP); Kouji Oonishi, Hyogo (JP); Keisuke Kido, Hyogo (JP); Junichi Sawada, Hyogo (JP)

(73) Assignee: Fujitsu Ten Limited, Kobe (JP)

( * ) Notice: Subject to any disclaimer, the term of this patent is extended or adjusted under 35 U.S.C. 154(b) by 532 days.

(21) Appl. No.: 11/067,986

(22) Filed: Mar. 1, 2005

(65) Prior Publication Data

US 2005/0231877 A1 Oct. 20, 2005

(30) Foreign Application Priority Data

Apr. 5, 2004 (JP) ..... P2004-111032

(51) Int. Cl.
*H01H 1/50* (2006.01)
*H01H 1/60* (2006.01)

(52) U.S. Cl. ..... 307/137; 324/421; 324/700

(58) Field of Classification Search ..... 307/137; 324/421, 700

See application file for complete search history.

(56) References Cited

U.S. PATENT DOCUMENTS

| | | | | |
|---|---|---|---|---|
| 4,504,743 | A * | 3/1985 | Aoyama et al. | 327/512 |
| 4,540,874 | A | 9/1985 | Shaffer, Jr. et al. | |
| 4,914,315 | A * | 4/1990 | Nickolai | 307/137 |
| 5,502,609 | A * | 3/1996 | Thomas et al. | 361/6 |
| 5,523,633 | A | 6/1996 | Imaizumi et al. | |
| 6,570,426 | B2 * | 5/2003 | Nakashimo | 327/265 |
| 7,109,721 | B2 * | 9/2006 | Maurer et al. | 324/421 |
| 7,119,799 | B2 * | 10/2006 | Kaski | 345/173 |
| 7,196,566 | B2 * | 3/2007 | Kaiser, Jr. | 327/308 |
| 7,362,011 | B2 | 4/2008 | Komatsu et al. | |
| 7,410,563 | B2 | 8/2008 | Komatsu et al. | |

FOREIGN PATENT DOCUMENTS

| | | |
|---|---|---|
| EP | 0 528 379 A2 | 2/1993 |
| JP | A 63-237319 | 10/1988 |
| JP | A 1-281621 | 11/1989 |
| JP | A 2-278620 | 11/1990 |
| JP | A 2-297818 | 12/1990 |
| JP | A 3-205710 | 9/1991 |
| JP | A 4-33220 | 2/1992 |
| JP | A 6-96637 | 4/1994 |
| JP | A 7-6650 | 1/1995 |
| JP | A 7-14463 | 1/1995 |
| JP | A 7-15301 | 1/1995 |
| JP | A 2001-84860 | 3/2001 |
| JP | A 2002-343171 | 11/2002 |

* cited by examiner

*Primary Examiner*—Albert W Paladini
*Assistant Examiner*—Hal I Kaplan
(74) *Attorney, Agent, or Firm*—Oliff & Berridge, PLC

(57) ABSTRACT

A circuit for preventing corrosion of a contact, includes an input terminal, a signal line, a switch, an impedance element, and a comparator. The input terminal is to be connected to the contact, which is outside the circuit. The signal line is connected to the input terminal. The switch is connected to the signal line. The impedance element is connected to the signal line in parallel to the switch. An impedance of the switching section is smaller than that of the impedance element. The comparator compares a potential of the signal line with a predetermined potential. The switch is turned on based on a comparison result output from the comparator.

10 Claims, 8 Drawing Sheets

FIG. 5

| SETTINGS OF INPUT CIRCUIT | FUNCTION FOR PREVENTING CORROSION OF CONTACT | SEL1 | SEL2 | SEL3 |
|---|---|---|---|---|
| L SIDE SW | ○ | H | L | H |
| L SIDE SW | × | H | L | L |
| H SIDE SW | ○ | L | H | H |
| H SIDE SW | × | L | H | L |
| WITHOUT PULL-UP/PULL-DOWN CONNECTION | × | L | L | L |

CIRCUIT FOR PREVENTING CORROSION OF CONTACT

BACKGROUND

1. Field of the Invention

The present invention relates to a circuit for preventing corrosion of a contact, the circuit having a function of applying current to and destroying an oxide layer developed by corrosion on contacts at a switch or a connector.

2. Description of the Related Art

Contacts such as those of a switch or a connector have been made of a metal material excellent in electric conduction so as to reduce a contact resistance on electric connection. There is a fear that such contacts may increase in contact resistance because a surface of a contact part is oxidized when a switch is turned off for disconnection. Further, when a contact is connected for turning on, there is a fear that a surface of a part exposed around the contact part may be oxidized, the oxide which is then caught in the contact part, thereby causing a slight sliding wear resulting in an increased contact resistance. If a contact state and a non-contact state are appropriately repeated and a relatively large current is allowed to flow during the contact state, such a current may be used to produce heat to remove the oxide, thereby preventing an increase in contact resistance even after the contact resistance is increased due to oxidation of contacts.

With regard to an input to an electronic device, it is in general not necessary to allow large current, which can prevent corrosion of a contact, to constantly flow into contacts. An intermittent flow of a large current may contribute to malfunctions due to noise. In addition, allowing a large current to flow into contacts may result in a greatly reduced electric life of contacts or adhesion of contacts. In order to solve these problems, JP-A-Hei.2-297818 discloses the following current control device. The device detects contact resistance of the contacts. When the contact resistance of a contact is equal to or larger than a predetermined reference value, the device allows a large current between the contacts.

FIG. 9 is a reprinted drawing of FIG. 1 of JP-A-Hei.2-297818. One end of a contact 1 such as a closing switch is connected to a +V power source. The other end of the contact 1 is grounded via a resistor 2 to a primary side of a photo coupler 3 (light-emitting diode). A secondary side of the photo coupler 3 (photo transistor) is connected between the +V power source and the ground via a resistor 4. The photo coupler 3 is turned on and off in accordance with opening and closing of the contact 1. On and off signals of the photo coupler 3 are output to a control circuit 5. A transistor 6 is connected via a resistor 7 to a series circuit of the resistor 2 and the primary side of the photo coupler 3, in parallel.

A detection circuit 16 detects whether or not a contact resistance of the contact 1 exceeds a certain value. The detection circuit 16 includes resistors 17, 18, 19, 20 and an operational amplifier 21. The resistors 17 and 18 are connected in series between the +V power source and the ground. A series circuit of the resistors 19 and 20 is connected in parallel to the series circuit of the resistor 2 to a primary side of the photo coupler 3. A connecting point P1 between the resistor 17 and the resistor 18 is connected to a non-inverting input terminal of the operational amplifier 21. An inverting input terminal of the operational amplifier 21 is connected to a connecting point P2 between the resistor 19 and the resistor 20. Thus, a voltage of Va produced at both ends of the resistor 18 by dividing a voltage of the +V power source by the resistors 17 and 18 is supplied to the non-inverting input terminal of the operational amplifier 21. Further, a voltage of Vb at both ends of the resistor 20 determined by the contact resistance of the contact 1 and the resistors 19 and 20 is supplied to the inverting input terminal thereof. Then, an output signal of the operational amplifier 21 activates a base of the transistor 6, which allows a load current I2 for removing disturbances flowing into the contact 1.

When the contact 1 is closed, a current I1 flows into the primary side of the photo coupler 3, so that the photo coupler 3 is operated and resultant signals are supplied to the control circuit 5. At this time, according to closing of the contact 1, the +V power source is supplied to the resistors 19 and 20 via the contact 1. Thus, voltage is generated on both ends of the resistor 20 according to the contact resistance of the contact 1. This voltage Vb on both ends thereof is supplied to the inverting input terminal of the operational amplifier 21. In this instance, the operational amplifier 21 compares the voltage Va with the voltage Vb to judge whether or not the contact resistance of the contact 1 is larger than the predetermined reference value.

If the contact resistance of the contact 1 becomes larger than the reference value due to generation of an insulating layer, Va is larger than Vb (Va>Vb). Thus, an output of the operational amplifier 21 becomes "H," and the transistor 6 is turned on so as to allow the load current I2 to flow via the series circuit of the resistor 7 and the transistor 6. As a result, a contact current I0=I1+I2. Since a current flowing through the contact 1 increases by a value of I2 greater than a usual value, it is expected that the insulating layer between the contacts is destroyed by Joule heat so as to reduce the contact resistance.

Also, U.S. Pat. No. 5,523,633 discloses a circuit for preventing corrosion of a switch for large current. The switch allows a large current in a pulse shape during a period in which a contact of the switch is turned on, when the switch for large current is employed in a low-current system such as electronic control units. In addition, JP-A-Hei.7-14463 discloses a device for discriminating contact signals. The device allows a corrosion-prevention current in a pulse shape to flow periodically by means of charge and discharge into a condenser. JP-A-2002-343171 also discloses a device for preventing corrosion of a contact of a switch. The device flows large current for preventing corrosion for at least a predetermined holding time from a time point where the contact of the switch is changed from an opened state to a closed state. When the contact of the switch is in the opened state, the device decreases an impedance of an input signal line connected to the contact.

SUMMARY

The devices disclosed in JP-A-Hei.2-297818, U.S. Pat. No. 5,523,633, and JP-A-2002-343171, flow current for preventing corrosion without judging whether or not a contact is corroded. Thus, there is a fear that the devices disclosed in the references may flow current for preventing corrosion even though corrosion does not occur or that the devices disclosed may flow insufficient current to prevent corrosion even if corrosion occurs.

In JP-A-Hei.2-297818, a contact resistance is detected by referring to a difference between the voltages Va and Vb obtained by dividing the voltage of contacts on both ends of the switch that opens and closes between the power source and the load. Thus, it is necessary to input into the detection circuit 16 not only the voltage on the contact side used as input to the control circuit 5, but also the voltage on the +V power source side. It is also possible to obtain a voltage on the +V power source side, from a current control device across the contacts. However, if a point where the voltage is obtained is apart from the contact of the switch, there is a fear that the voltages may vary due to effects of noise. Further, in JP-A-Hei.2-297818, in order to check the contact voltage of the contact, voltage is obtained from a potential different from that on an input signal line used to judge an on/off state of the contacts. Therefore, it is necessary for JP-A-Hei.2-297818 to provide a special logic, resulting in the complicated configuration.

The invention provides a circuit for preventing corrosion of a contact. The circuit can judge proceeding of corrosion of the contact appropriately with a simple configuration to ensure effective prevention of the corrosion. The circuit also can take measures against noise.

According to one embodiment of the invention, a circuit for preventing corrosion of a contact, includes an input terminal, a signal line, a switch, an impedance element, and a comparator. The input terminal is to be connected to the contact, which is outside the circuit. The signal line is connected to the input terminal. The switch is connected to the signal line. The impedance element is connected to the signal line in parallel to the switch. An impedance of the switching section is smaller than that of the impedance element. The comparator compares a potential of the signal line with a predetermined potential. The switch is turned on based on a comparison result output from the comparator.

With this configuration, the circuit for preventing the corrosion of a contact includes the input terminal, the signal line, the switch, the impedance element, and the comparator. The signal line is connected to the input terminal, which is connected to the contact being outside the circuit. By means of the potential of the signal line, a state of the contact can be determined. That is, when the contact is closed, a part, which is electrically connected due to the closed state, influences on the potential of the signal line. On the other hand, when the contact is opened, there is no such influence on the potential of the signal line. The switch and the impedance element are connected to the signal line. When the switch is activated, the corrosion-prevention current for the contact is allowed to flow into the input terminal. The comparing section compares the potential of the signal line with the predetermined potential to judge the potential of the signal line. Since the potential of the signal line connected to the contact is compared with the predetermined potential directly to judge whether or not the corrosion occurs, the proceeding state of the corrosion of the contact can be judged appropriately. Thus, effective measure for the corrosion prevention can be made.

When the contact is closed, a part, which is electrically connected due to the closed state, influences on the potential of the signal line. On the other hand, when the contact is opened, there is no such influence on the potential of the signal line. Therefore, the state of the contact can be judged on a basis of the potential of the signal line. The comparator discriminates the potential of the signal line by comparing the potential of the signal line with the predetermined potential. The circuit described above judges whether or not the corrosion occurs by comparing the potential of the signal line, which is originally used for judging the connection state of the contact, with the predetermined potential. Therefore, it is not necessary for set dedicated logic. Also, the proceeding state of the corrosion of the contact can be judged appropriately and easily. For example, if it is known in advance that the closed/opened voltages of the contact can be judged at 0V and 5V, respectively, the predetermined potential is set between 0V and 5V. In JP-A-Hei.2-297818, it is necessary to set a potential to be compared and a reference voltage corresponding to the potential to be compared. Therefore, its configuration becomes complicate. When the potential of the signal line becomes a potential indicating occurrence of the corrosion, the comparing section activates (turns on) the switch and allows the corrosion-prevention current for the contact into the input terminal. Therefore, if the contact is brought into the closed state, the corrosion-prevention current flows and effective measure for corrosion-prevention can be provided. Also, by providing just one predetermined potential with the comparing section, the opened state/closed state of the contact can be known. Therefore, the single comparator has both a function of judging whether the contact is closed or opened and a function of judging whether or not the contact is corroded. Furthermore, the comparing section makes the input impedance to be low impedance. Therefore, a noise countermeasure such as EMI can be achieved. In other words, the corrosion prevention and the noise countermeasure can be provided with a simple configuration.

BRIEF DESCRIPTION OF THE DRAWINGS

FIG. 5 is a table showing relation between selected functions of the input circuit block 102C and the three selection signals SEL1, SEL2 and SEL3 shown in FIG. 4.

DETAILED DESCRIPTION OF EMBODIMENTS

Respective embodiments of the invention will be described with reference to FIGS. 1 to 8. In each of the embodiments, the same reference numbers are given to parts equivalent to those for which a prior description is made, thereby omitting overlapping description. However, parts to which the same reference numbers are given are not necessarily structured in an exactly the same way. As a matter of course, various modifications may be made.

Figure 1A:
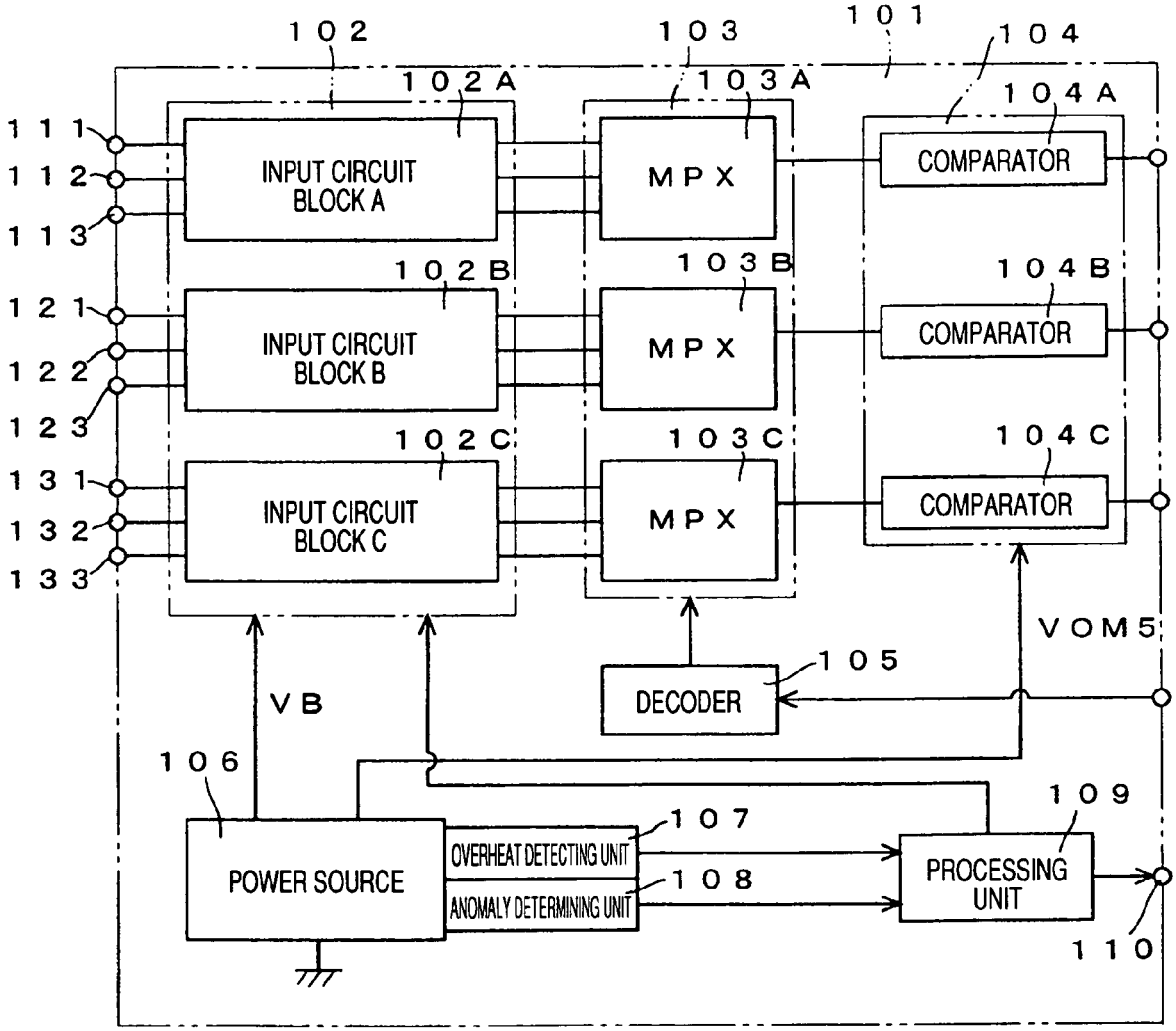
FIG. 1A is a block diagram illustrating a schematic electrical configuration of a circuit 101 for preventing corrosion of a contact, according to one embodiment of the invention.
Figure 1B:
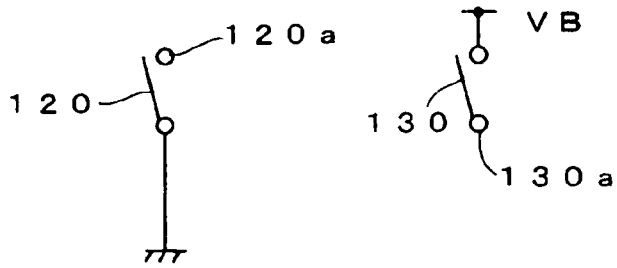
FIG. 1B is a circuit diagram illustrating a connecting configuration of a contact assumed to be connected.

FIG. 1A shows a schematic electrical configuration of a circuit 101 for preventing corrosion of a contact according to an embodiment of the invention. FIG. 1B shows a connecting configuration between contacts. As shown in FIG. 1A, a circuit 101 for preventing corrosion of a contact is formed as a large-scale integrated circuit ("LSI") having a function of selecting plural input signals. More specifically, the circuit 101 includes an input circuit block 102 having plural channels, selects output of the plural channels from the input circuit block 102 by using a multiplexer 103, makes a logic judgment by using a comparator 104 and outputs a judgment result. The input circuit block 102 includes an input circuit block A 102A, an input circuit block B 102B and an input circuit block C 102C each being different in a circuit configuration. The multiplexer 103 includes an MPX 103A for selecting a channel of the input circuit block A 102A, MPX 103B for selecting a channel of the input circuit block B 102B and an MPX 103C for selecting a channel of the input circuit block C102C. Comparators 104A, 104B and 104C in the comparator 104 judge which logical value inputs selected by the MPX 103A, 103B and 103C correspond to, respectively. The multiplexer 103 selects a channel according to an output from a decoder 105.

A positive power-supply voltage VB is supplied to the input circuit block 102 from a power source 106. A +5V supply voltage VOM5 for a logic circuit is supplied from the power source 106 to the comparator 104. A overheat detecting unit 107 and an anomaly determining unit 108 are provided adjacently to the power source 106. Detection results of the overheat detecting unit 107 and judgment results of the anomaly determining unit 108 are sent to a processing unit 109. The processing unit 109 performs operations including output of abnormal signals to an external terminal 110, as a protecting operation.

As shown in FIG. 1A, plural input channels of the input circuit block A 102A are connected to input terminals 111, 112, 113, . . . , respectively. It is assumed that the each of the input terminals 111, 112, 113, . . . are connected to a contact 120*a* of a switch 120 serving as a low-side switch, as shown in FIG. 1B. As shown in 1A, plural input channels of the input circuit block B 102B are connected to input terminals 121, 122, 123, . . . , respectively. As shown in FIG. 1A, it is assumed that each of the input terminals 121, 122, 123, . . . is connected to a contact 130*a* of a switch 130 serving as a high-side switch. As shown in 1A, plural input channels of the input circuit block C 102C are connected to input terminals 131, 132, 133, . . . , respectively. It is assumed that each of the input terminals 131, 132, 133, . . . , is connected to either the contact 120*a* of the switch 120 serving as a low-side switch or the contact 130*a* of the switch 130 serving as a high-side switch. Further, it may be assumed that the respective input terminals 111, 112, 113, . . . , 121, 122, 123, . . . and 131, 132, 133, . . . are connected not only to the switch 120 and the switch 130 but also to connectors. Specifically, a connecting state of a contact means an opened state/closed state of a switch and/or a connecting state/non-connecting state of an external connector.

Figure 2:
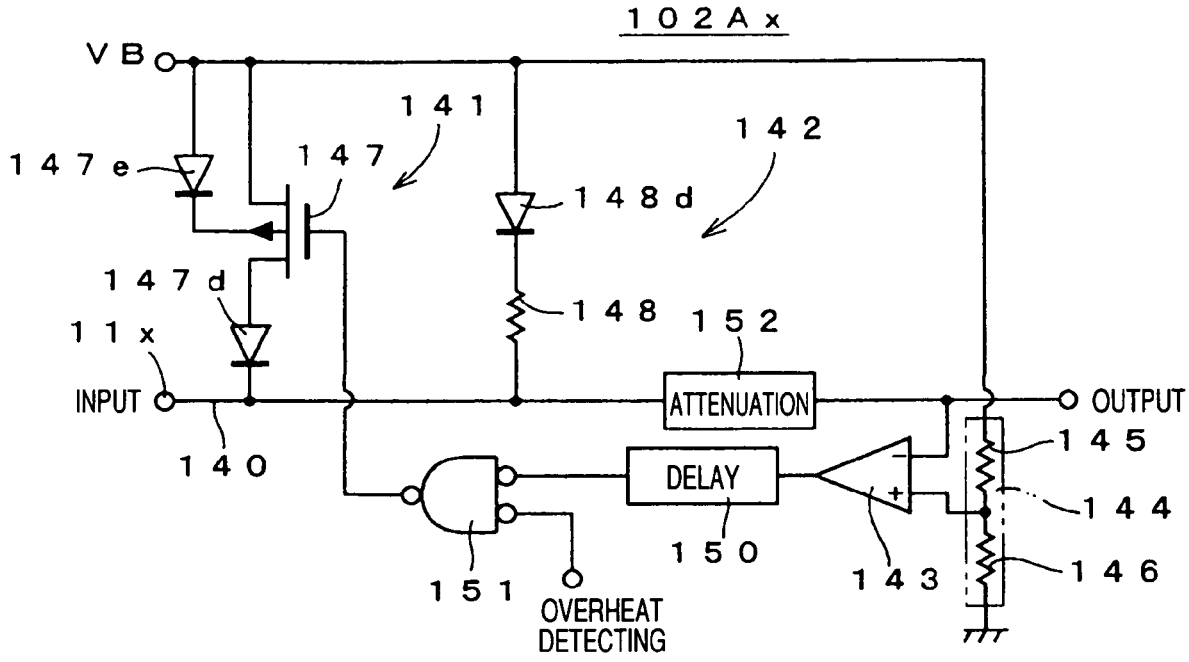
FIG. 2 is a block diagram illustrating a schematic electrical configuration of a circuit 102A for preventing corrosion of a contact, for one channel of an input circuit block A 102A shown in FIG. 1.

FIG. 2 shows a schematic electrical configuration of a circuit 102Ax for preventing corrosion of a contact, provided at one channel of the input circuit block A 102A. An input signal line 140 is to be connected to the comparator 104A. Judgment as to whether a switch and a connector are turned on or off is made on a basis of a potential of the signal line 140. It is assumed that an input terminal 11*x* to which the input signal line 140 is connected is used while a contact on the lower side of the power source 106 is connected thereto, for example, the contact 120*a* shown in FIG. 1B. To the input signal line 140, a low impedance section 141 (serving as a switching section), a high impedance section 142 (serving as an impedance element), and a comparing section 143 (serving as a comparator) are connected. The low impedance section 141 includes an impedance, through which a corrosion-prevention current can flow through the contact. The high impedance section 142 fixes a logic value of the input signal line 140 when the contact is in an off state. The high impedance section 142 has a higher impedance than the low impedance section 141. The comparing section 143 compares a potential of the input signal line 140 with a predetermined potential, which is obtained by a voltage dividing circuit 144 for dividing the power source voltage VB and the ground voltage. The voltage dividing circuit 144 is formed of a series circuit of resistors 145 and 146. The low impedance section 141 includes a switching element 147, which is a P channel MOS transistor. The high impedance section 142 includes a pull-up resistor 148. A diode 148*d* is connected in series to the pull-up resistor 148, thereby preventing a reverse current from flowing. The comparing section 143 is a comparator, which compares the predetermined potential with the potential of the input signal line 140 to judge whether or not the contact is corroded. The comparing section 143 outputs a high-level signal or a low-level signal depending on whether or not the potential of the input signal line 140 exceeds the predetermined potential. The predetermined potential is set between a potential when the contact is closed and that when the contact is opened. When the potential of the input signal line 140 exceeds the predetermined potential, the contact is corroded (or is to be corroded). The predetermined potential is set in advance so as to satisfy the above-described conditions. The predetermined potential may also be used as a potential for judging an opened state/closed state of the contact. An output of the comparing section 143 is given to a gate of the switching element 147 via a delay circuit 150 and a gate circuit 151. When a P channel MOS transistor is used as the switching element 147, a diode 147*d* is connected between the drain thereof and the input signal line 140 to inhibit a reverse current from flowing. A diode 147*e* is also connected between the back gate of the P channel MOS transistor and the power source voltage VB. An overheat detecting signal from the processing unit 109 shown in FIG. 1 is given to one input of the gate circuit 151. If overheat is not detected, the overheat detecting signal is kept at a low level. If overheat is detected, the overheat detecting signal is raised to a high level, thereby prohibiting the switching element 147 from turning on. The gate circuit 151 is equivalent to an OR circuit.

Specifically, the contact 120*a* shown in FIG. 1B is connected between the pull-up resistor 148 on the power source voltage VB side and the ground. Therefore, when the contact 120*a* is opened, the potential of the input signal line 140 connected to the contact 120*a* via the input terminal 11*x* is a potential on the power source voltage VB side connected thereto via the pull-up resistor 148. On the other hand, when the contact 120*a* is closed, the potential of the input signal line 140 is determined by the potential of the ground. If the contact 120*a* is corroded and increases its contact resistance, potential drop becomes large due to the contact resistance in the closed state of the contact 120*a*. As a result, when the contact 120*a* is closed, the potential of the input signal line 140 increases. When the comparing section 143 detects that a resistance of the contact 120*a* increases due to corrosion at a time of connection or that the contact 120*a* is cut off by detecting that the potential of the input signal line 140 rises to exceed the predetermined potential, the comparing section 143 activates the low impedance section 141 (turns on the switching element 147). In FIG. 2, when an output of the comparing section 143 serving as the comparator is at low level and after delay by the delay circuit 150 the overheat detecting signal is at low level, the gate circuit 151 outputs a driving signal of a low level to turn on the switching element 147, which is the P channel MOS transistor. As a result, the low impedance section 141 is activated. When the low impedance section 141 is activated by the comparator 143, the impedance of the low impedance section 141 lowers, so that an impedance of a parallel circuit of the low impedance section 141 and the pull-up resistor 148 decreases. Therefore, current flows from the power source voltage VB side through the low impedance section 141, which has decreased its impedance, into the contact 120*a* in the closed state, to thereby heat the contact 120*a* and remove the corrosion. Also, by providing just one predetermined potential using the comparing section 143, the potential of the input signal line 140 exceeds the predetermined potential when the contact 120*a* is turned off. Therefore, an input may be in a low-impedance state, so that a noise countermeasure such as EMI can be achieved.

Figure 3:
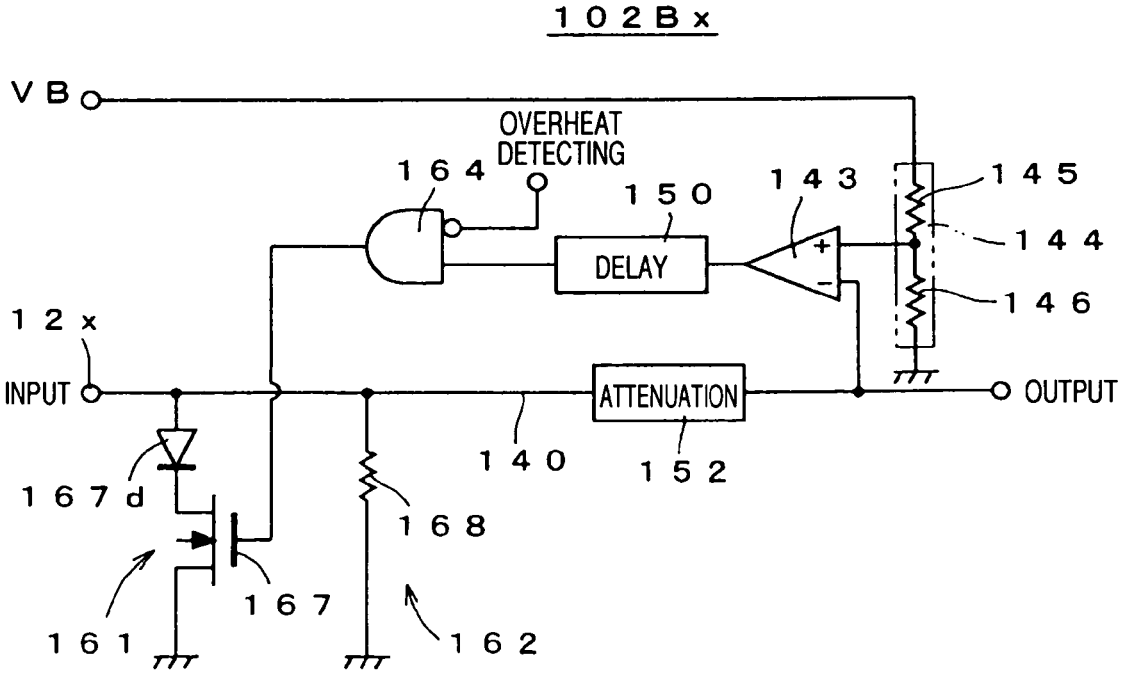
FIG. 3 is a block diagram illustrating a schematic electrical configuration of a circuit 102Bx for preventing corrosion of a contact, for one channel of an input circuit block B 102B shown in FIG. 1.

FIG. 3 shows a schematic electrical configuration of the circuit 102Bx for preventing corrosion of a contact at one channel of the input circuit block B 102B. It is assumed that an input terminal 12*x* to which the input signal line 140 is connected is used while a contact on the high side of the power source 106 is connected thereto, for example, a contact 130*a* shown in FIG. 1B. A low impedance section 161 (e.g., a switching section), a high impedance section 162 (e.g., an impedance element), and a comparing section 143 (e.g., a comparator) are connected to the input signal line 140. An output of the comparing section 143 is given from the delay circuit 150 to a gate circuit 164. The low impedance section 161 includes a switching element 167, which is an N channel MOS transistor. The high impedance section 162 includes a pull-down resistor 168. The comparing section 143 is a comparator. An output of the comparing section 143 is given via the delay circuit 150 and the gate circuit 164 to the gate of the switching element 167. When the N channel MOS transistor is used as the switching element 167, a diode 167*d* is connected between the drain thereof and the input signal line 140 to inhibit a reverse current from flowing. An overheat detecting signal from the processing unit 109 shown in FIG. 1 is given to one input of the gate circuit 164. If overheat is not detected, the overheat detecting signal is kept at a low level. If overheat is detected, the overheat detecting signal is raised to a high level, to thereby prohibit the switching element 167 from turning on.

Specifically, the contact 130*a* shown in FIG. 1B is connected between the pull-down resistor 168 on the power source voltage VB side and the ground. Therefore, when the contact 130*a* is closed, a potential of the input signal line 140 connected to the contact 130*a* via the input terminal 120*x* is a potential on the ground side connected via the pull-down resistor 168. On the other hand, when the contact 130*a* is opened, the potential of the input signal line 140 is a potential on the voltage VB side. If the contact 130*a* is corroded and increases its contact resistance, potential drop becomes large due to the contact resistance in the closed state of the contact 130*a*. As a result, when the contact 130*a* is closed, the potential of the input signal line 140 lowers. When the comparing section 143 detects that the a resistance of the contact 130*a* lowers due to corrosion at a time of connection or that the contact 130*a* is cut off by detecting that the potential of the input signal line 140 lowers to be less than the predetermined potential, the comparing section 143 activates the low impedance section 161 (that is, turns on the switching element 167). In FIG. 3, when an output of the comparing section 143 serving as the comparator is at a high level and after delay by the delay circuit 150, the overheat detecting signal is at a low level, the gate circuit 164 outputs a driving signal of a high level to turn on the switching element 167, which is the N channel MOS transistor. As a result, the low impedance section 161 is activated. When the low impedance section 161 is activated by the comparing section 143, the impedance of the low impedance section 161 lowers, so that an impedance of a parallel circuit of the low impedance section 161 and the pull-down resistor 168 lowers. Therefore, current, which flows through the low impedance section 161 having been decreased in impedance into the ground side, flows into the contact 130*a* in the closed state, to thereby heat the contact 130*a* and remove the corrosion.

Figure 4:
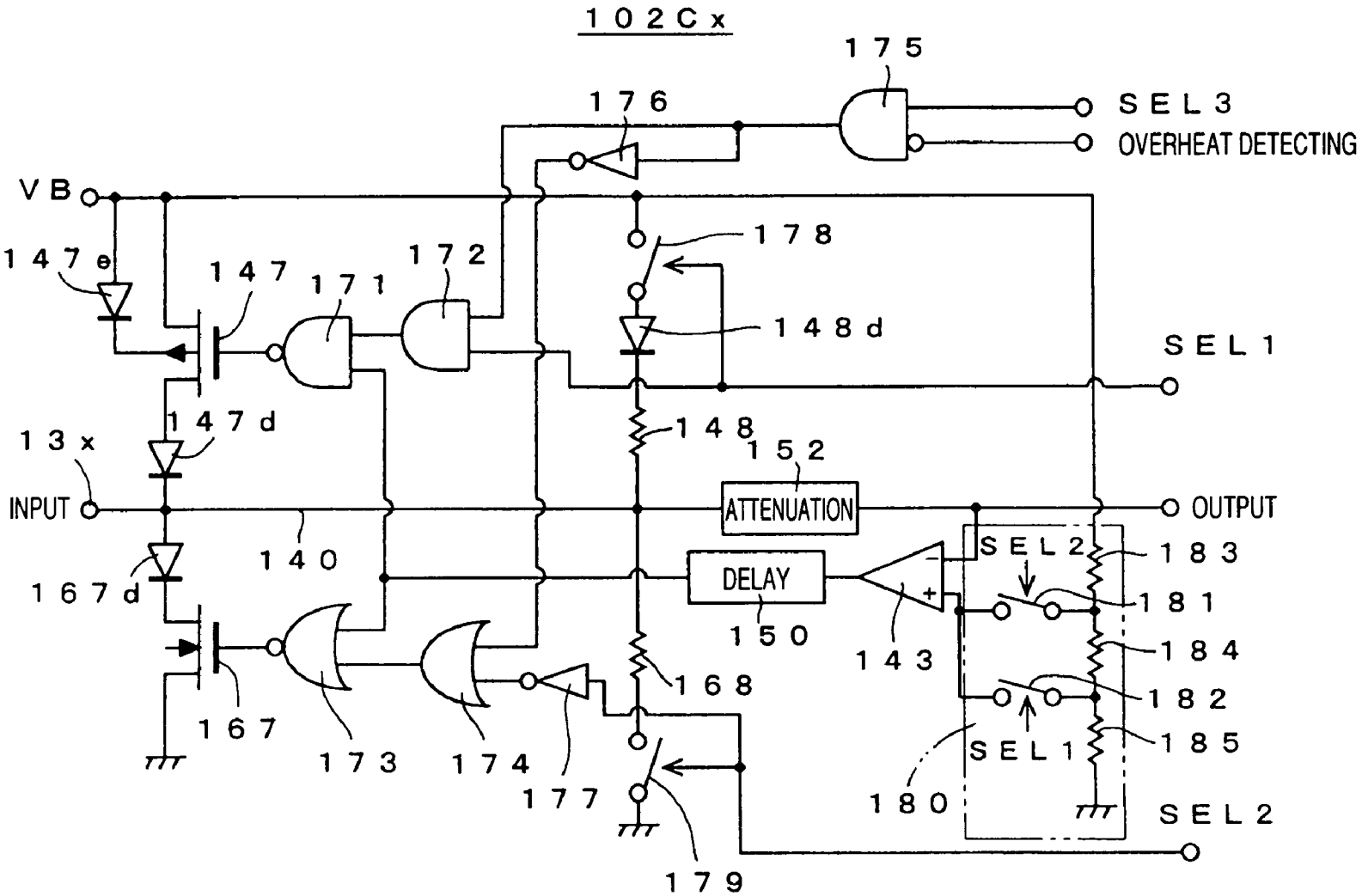
FIG. 4 is a block diagram illustrating a schematic electrical configuration of a circuit 102Cx for preventing corrosion of a contact, for one channel of an input circuit block C 102C shown in FIG. 1.

FIG. 4 shows a schematic electrical configuration of a circuit 102Cx for preventing corrosion of a contact, at one channel of the input circuit block C 102C. It is assumed that an input terminal 13*x* to which the input signal line 140 is connected is used not only as a contact on the low side of the power source 106, such as the contact 120*a* shown in FIG. 1B, but also as a contact on the high side of the power source 106 such as the contact 130*a* shown in FIG. 1B. A logic output of the comparing section 143, which serves as a comparator, is given to the switching element 147 via a NAND circuit 171 to which an output from the delay circuit 150 is given as one input. The output from an AND circuit 172 is given to the NAND circuit 171 as another input. The logic output of the comparing section 143 is also given to the switching element 167 via a NOR circuit 173 to which the output from the delay circuit 150 is given as one input. The output from an OR circuit 174 is given to the NOR circuit 173 as another input. An output from a gate circuit 175 and an input of SEL1 are given to the AND circuit 172. A signal, which is obtained by inverting the output of the gate circuit 175 by an inverter 176, and a signal, which is obtained by inverting an input of SEL2 by an inverter 177, are given to the OR circuit 174. An input signal SEL3 and the overheat detecting signal are given to the gate circuit 175.

When the input SEL1 is at a high level, a switch 178 is turned on to thereby connect the resistor 148 between the input signal line 140 and the power source voltage VB as a high impedance section. When the input of the SEL2 is at a high level, a switch 179 is turned on to thereby connect the resistor 168 between the input signal line 140 and the ground as a high impedance section. When the input SEL1 and the input SEL2 are at the high level, switches 182 and 181 in a voltage dividing circuit 180 are turned on, respectively. Thereby, the voltage dividing circuit 180 formed of the resistors 183, 184 and a resistor 185 is switched to change a predetermined potential used in corrosion judgment by the comparing section 143.

FIG. 5 shows relationships between selected functions of the input circuit block 102C and the three selection signals SEL1, SEL2 and SEL3 shown in FIG. 4. When SEL1 is raised to a high level, a switch (120) can be connected to a low side, or lower voltage connection, as with the input circuit block A 102A. When the SEL2 is raised to a high level, a switch (130) can be connected to a high side, or higher voltage connection, as with the input circuit block B 102B. When the SEL3 is raised to a high level, a function of preventing corrosion of a contact is set to on.

Specifically, in the circuit 102Cx for preventing corrosion of a contact, the contact 120*a* is connected to the low side of the power source 106 and is disposed between the pull-up resistor 148 connected to the power source voltage VB and the ground; and the contact 130*a* is connected to the high side of the power source 106 and is disposed between the power source voltage VB and the pull-down resistor 168 connected to the ground. The comparing section 143 can select the predetermined potential for the low side and that for the high side, which are compared with the potential of the input signal line 140. When the predetermined potential for the low side is selected, the comparing section 143 detects that a resistance of the contact 120*a* increases due to corrosion at a time of connection or that the contact 120*a* is cut off by detecting that the potential of the input signal line 140 rises to exceed the predetermined potential for the low side. When the predetermined potential for the high side is selected, the comparing section 143 detects that a resistance of the contact 130*a* increases due to corrosion at a time of connection or that the contact 130*a* is cut off by detecting that the potential of the input signal line 140 drops to less than the predetermined potential for the high side. The low impedance section 141 includes the switching element 147 for pull-up, which decreases the impedance of a parallel circuit of the pull-up resistor 148 and the switching element 147 when the comparing section 143 selects the predetermined potential for the low side and the comparing section 143 activates the low impedance section 141 (the switching element 147). The low impedance section 161 includes the switching element 167 for pull-down, which decreases the impedance of a parallel circuit of the pull-down resistor 168 and the switching element 167 when the comparing section 143 selects the predetermined potential for the high side and the comparing section 143 activates the low impedance section 141 (the switching element 167).

As described above, the contact 120*a* is connected to the low side of the power source 106 and disposed between the pull-up resistor 148 connected to the power source voltage VB side and the ground; and/or the contact 130*a* is connected the high side of the power source 106 and disposed between the power source voltage VB and the pull-down resistor 168 connected to the ground. Therefore, in either case where a contact is connected to the high side or the low side, the circuit 102Cx can apply a corrosion prevention voltage to the contact. The comparing section 143 can select the predetermined potential for the high side and that for the low side, which are compared with the potential of the input signal line 140, by switching the switches 181, 182 of the voltage dividing circuit 180. When the comparing section 143 selects the predetermined potential for the low side, the comparing section 143 activates the switching element 147 serving as the low impedance section for pull-up, which decreases the impedance of the parallel circuit of the pull-up resistor 148 and the switching element 147. When the comparing section 143 selects the predetermined potential for the high side, the comparing section 143 activates the switching element 167 serving as the low impedance section for pull-down, which decreases the impedance of the parallel circuit of the pull-down resistor 168 and the switching element 167. Therefore, in either case where the contact (120*a*, 130*a*) is connected to the high side or the low side, the circuit 102Cx flows current into the contacts 120*a*, 130*a* in the closed state to thereby heat the contacts 120*a*, 130*a* and remove the corrosion thereof.

Figure 6A:
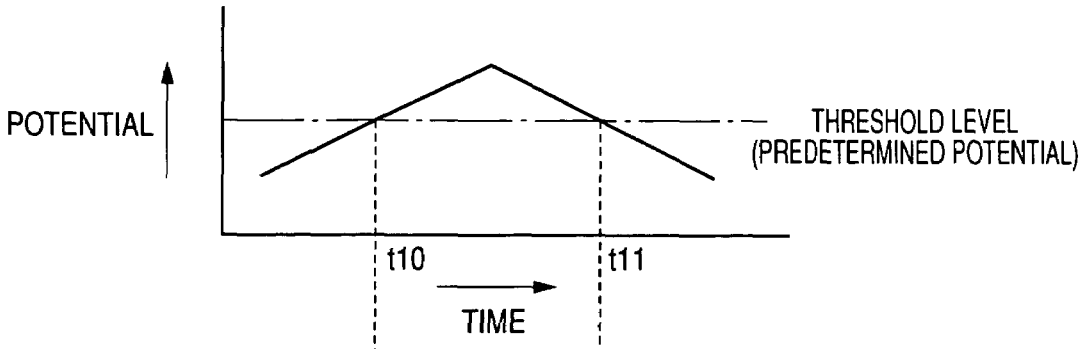
FIG. 6A shows changes in a voltage of an input signal line 140, which is input to a comparing section 143 (comparator).
Figure 6B:
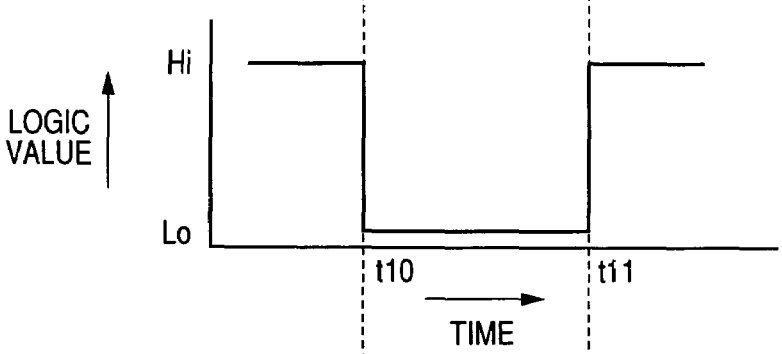
FIG. 6B shows a logic output of the comparing section 143.
Figure 6C:
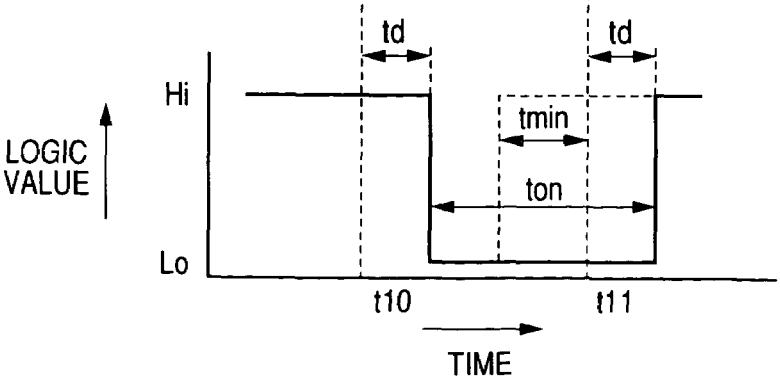
FIG. 6C shows an output of a delay circuit 150.

FIG. 6 shows an operation of the delay circuit 150 shown in FIGS. 2 to 4. FIG. 6A shows changes in the voltage of the input signal line 140, which is input to the comparing section 143 (comparator). FIG. 6B shows the logic output of the comparing section 143. FIG. 6C shows the output of the delay circuit 150. When the input of the comparing section 143 exceeds a threshold level (the predetermined potential) from time t10 to time t11 as shown in FIG. 6A, the output of the comparing section 143 drops to a low level as shown in FIG. 6B. The delay circuit 150 has, for example, delay time td of about 5 μs. When the same logic value is continuously kept for the delay time td, the delay circuit 150 outputs a logic value after the delayed time td has elapsed. Therefore, as shown in 6C, after the delay time td elapses from the time t10, the output of the delay circuit 150 drops to a low level. As shown by the dotted line in FIG. 6C, the high level is kept for a minimum time tmin, which is substantially identical to the delay time td. If time from t10 to t11 is longer than the delay time td, the output of the delay circuit 150 is changed to the high level after the delay time td elapsed from the time t11.

When the comparing section 143 controls the switching elements 147, 167 to make the input signal line 140 be low impedance and corrosion-prevention current flows, the delay circuit 150 keeps a state where the corrosion-prevention current flows, for at least the predetermined minimum time tmin. When the comparing section 143 judges that the contact (120*a*, 130*a*) is corroded and the corrosion-prevention current flows, there is a fear that chattering of corrosion-prevention operation may occur, that is, the voltage of the input signal line 140 may vary and judgment that the corrosion occurs is repeatedly made. However, by means of the delay circuit 150, the corrosion-prevention current is kept flowing for at least the predetermined minimum time tmin. Therefore, while the contacts 120*a*, 130*a* are prevented from being corroded, the chattering of the corrosion-prevention operation is prevented. Accordingly, when the contacts 120*a* and 130*a* are used in an electronic control device, malfunction can be prevented. Also, although the delay circuit 150 is provided in this embodiment, the delay circuit 150 may be omitted depending on an application.

The circuit for preventing corrosion of a contact includes the input signal line 140 for each contact. The overheat detecting unit 107 detects whether or not a predetermined overheat state occurs during a period where the corrosion-prevention current flows into the input signal line 140 of any of the channels. When the corrosion-prevention current does not flow, minimal heat may be generated. Therefore, the overheat state does not occur. The processing unit 109 responds to a detection result by the overheat detecting unit 107. When the overheat detecting unit 107 detects the overheat state, the processing unit 109 functions as an operation inhibiting section that inhibits the switching elements 147, 167, which serve as the low impedance sections for a channel where the corrosion-prevention current flows, from allowing the flow of the corrosion-prevention current. The processing unit 109 has a function of detecting whether or not the corrosion-prevention current flows in each channel and a function of raising only the overheat detecting signal for a channel where the corrosion-prevention current flows to a high level. When an abnormal operation occurs where the corrosion-prevention current keeps flowing in one channel, the processing unit 109 inhibits the corrosion-prevention current from flowing in the channel to protect the channel and reduce heat generation while allowing the corrosion-prevention current to flow in the other channels (the corrosion-prevention function in the other channels is prevented from being ineffective).

Also, the anomaly determining unit 108 monitors the corrosion-prevention current flowing into each of the input signal lines 140 from the power source 106. When a period where the corrosion-prevention current flows in one channel of the input signal line 140 overlaps at least partly with a period where the corrosion-prevention current flows in another channel of the input signal line 140, the anomaly determining unit 108 concludes that an anomaly occurs. Since the corrosion-prevention current does not flow often, it is not expected that the corrosion-prevention current often flows into a plurality of contacts simultaneously. When the contact is abnormal, with respect at least to an abnormal level of corrosion, the corrosion-prevention operations for the respective contacts are performed independently. Therefore, there is a possibility that the corrosion-prevention operations may overlap in terms of time. The anomaly determining unit 108 monitors the corrosion-prevention current flowing into each of the input signal lines 140 from the power source 106. When a period where the corrosion-prevention current flows in one channel of the input signal line 140 overlaps at least partly with a period where the corrosion-prevention current flows in another channel of the input signal line 140, the anomaly determining unit 108 concludes that an anomaly occurs. Therefore, judgment as to whether or not the contact is abnormal can be made easily.

Figure 7:
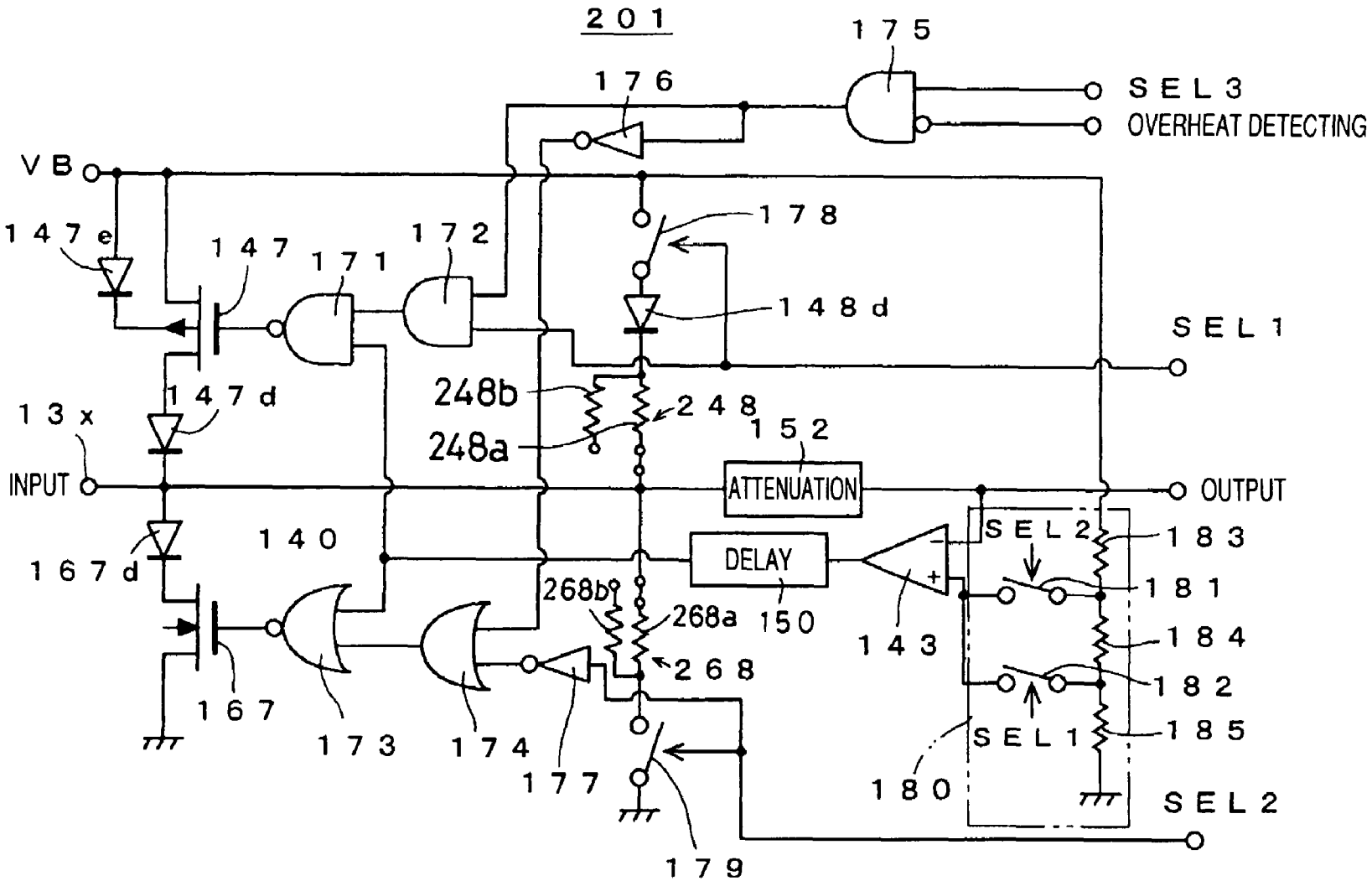
FIG. 7 is a block diagram illustrating a schematic electrical configuration of a circuit 201 for preventing corrosion of a contact, according to another embodiment of the invention.

FIG. 7 shows a schematic electrical configuration of a circuit 201 for preventing corrosion of a contact, according to another embodiment of the invention. In place of the pull-up resistor 148 and the pull-down resistor 168 provided in the circuit 102Cx shown in FIG. 4, the circuit 201 for preventing the corrosion of a contact includes a pull-up resistor 248 and a pull-down resistor 268, which can select those resistance values from a plurality of resistance values. Specifically, the pull-up resistor 248 can select one of plural resistors 248*a*, 248*b*, . . . . The pull-down resistor 268 can select one of plural resistors 268*a*, 268*b*, . . . . The circuit 201 for preventing the corrosion of a contact can also select the predetermined potential of the comparing section 143 from plural predetermined potentials by using the voltage dividing circuit 180. In a case where the corrosion prevention is applied to the contact 120*a* on the low side, which uses the pull-up resistor 148, as with the circuit 102Ax for preventing the corrosion of a contact shown in FIG. 2, only the pull-up resistor 248, which can select one of the plural resistance values, may be provided. In a case where the corrosion prevention is applied to the contact 130*a* on the high side, which uses the pull-down resistor 168, as with the circuit 102Bx for preventing the corrosion of a contact shown in FIG. 3, only the pull-down resistor 268, which can select one of the plural resistance values, may be provided. Since the pull-up resistor 248 and the pull-down resistor 268 can select those resistance values from the plural resistance values, those resistance values may be selected in accordance with the use state of the contacts 120*a*, 130*a* and the proceeding state of the corrosion so as to adjust and flow the appropriate corrosion-prevention current. Since the comparing section 143 can select one of the plural potentials, the predetermined potential may be selected appropriately in accordance with the use environment so as to judge the corrosion state precisely.

Figure 8:
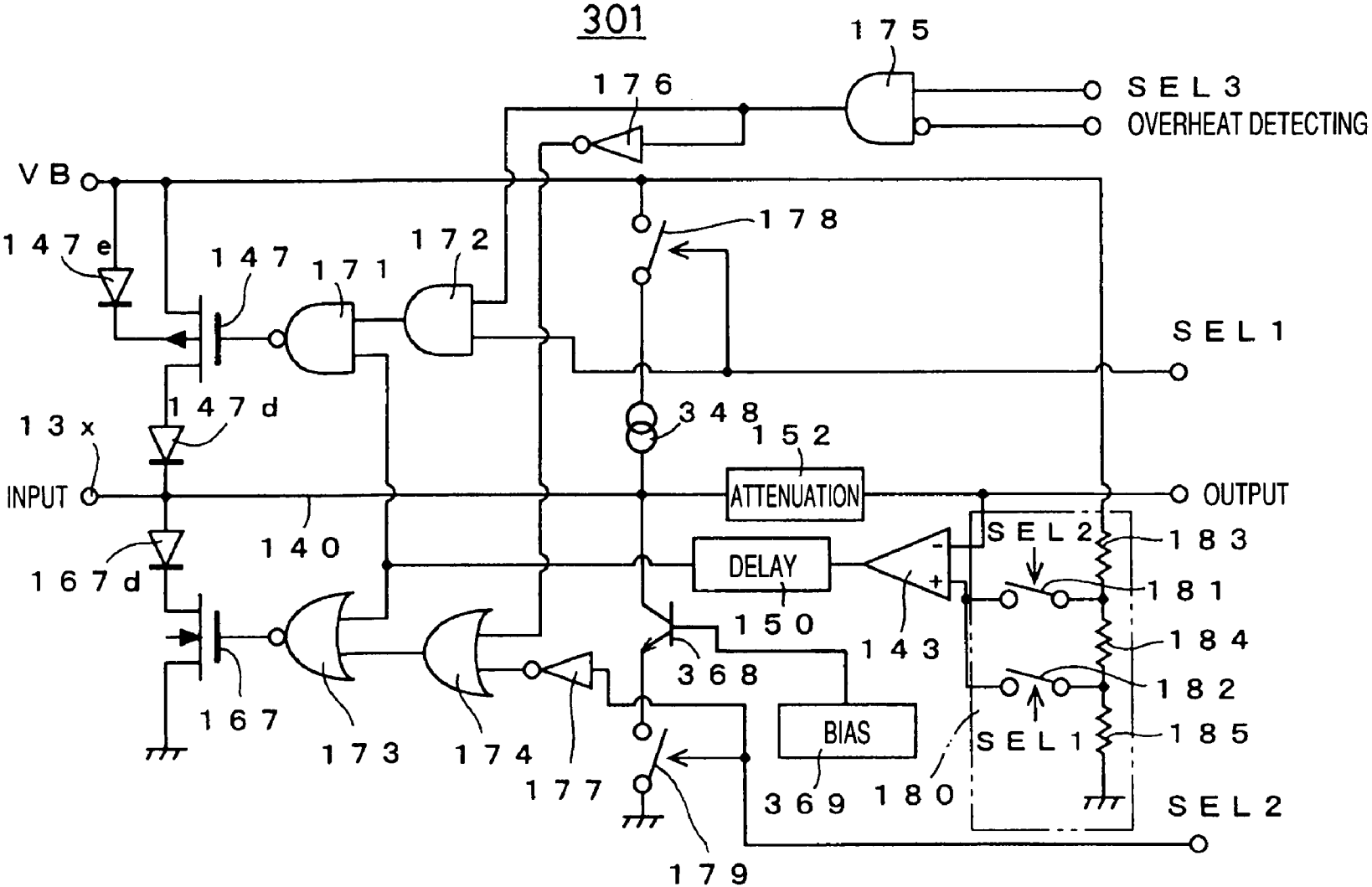
FIG. 8 is a block diagram illustrating a schematic electrical configuration of a circuit 301 for preventing corrosion of a contact, according to still another embodiment of the invention.
Figure 9:
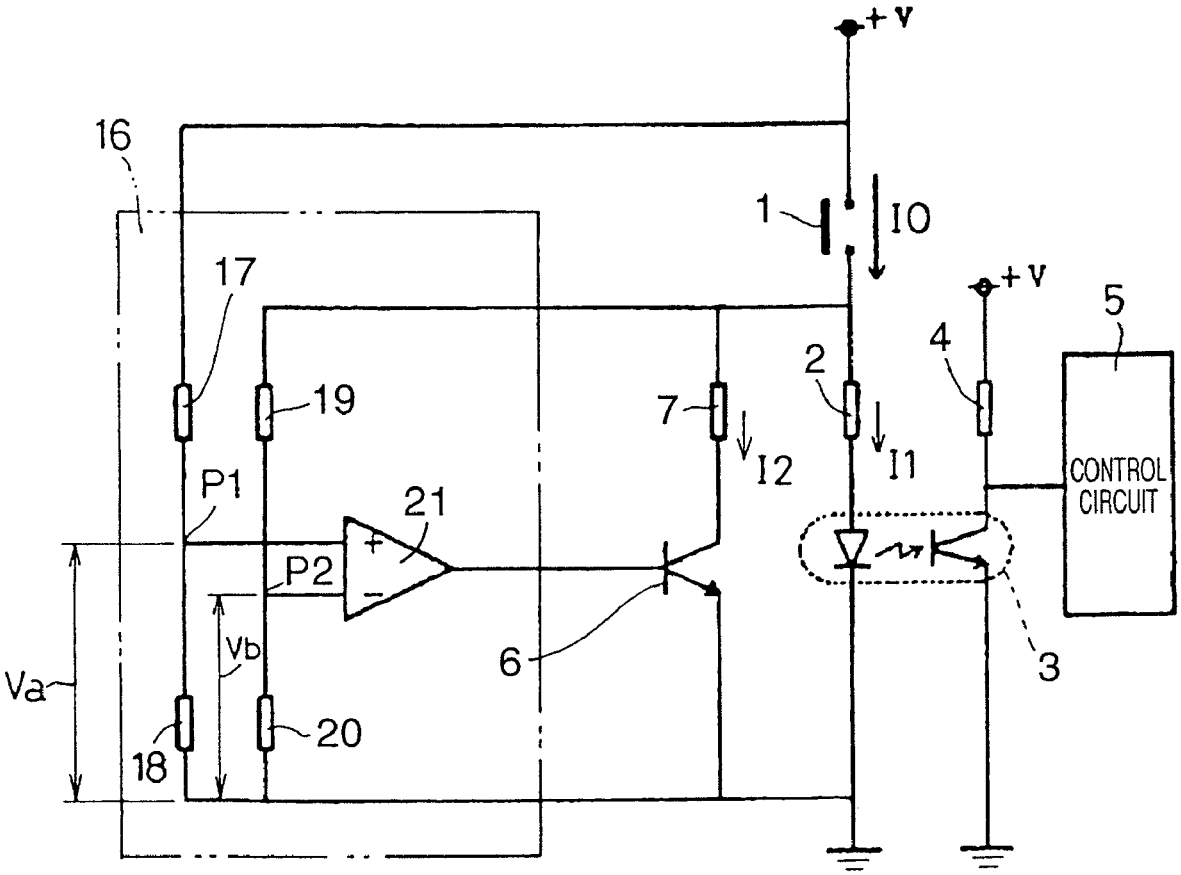
FIG. 9 PRIOR ART
FIG. 9 is a block diagram illustrating a schematic electrical configuration disclosed in JP-A-Hei.2-297818.

FIG. 8 shows a schematic electrical configuration of a circuit 301 for preventing corrosion of a contact, according to still another embodiment of the invention. As with the circuit 102Cx for preventing the corrosion of the contact shown in FIG. 4, it is assumed that the circuit 301 for preventing the corrosion of the contact is connected to the contact 120*a* on the low side and/or the contact 130*a* on the high side. In place of the pull-up resistor 148 of the circuit 102Cx, the circuit 301 uses a current source 348. Also, in place of the pull-down resistor 168 of the circuit 102Cx, the circuit 301 uses a bipolar transistor 368 and a bias circuit 369. The current source 348 supplies a constant current and has a high internal impedance. The bipolar transistor 368 can change an equivalent resistance between the collector and the emitter by adjusting bias by means of the bias circuit 369. The replacement may be made with respect to either one of the pull-up resistor 148 and the pull-down resistor 168. Also, the pull-up resistor 148 may be replaced with a semiconductor element such as a bipolar transistor or a MOS transistor, and the pull-down resistor 168 may be replaced with a current source. As described above, an impedance of a semiconductor element and/or a current source may be used as the resistor (the pull-up resistor and the pull-down resistor). Therefore, it becomes possible to adjust current value by controlling the semiconductor element so as to change its impedance. Also, it becomes possible to flow a constant current from the current source.

As described above, the circuit (102Ax, 102Bx, 102Cx, 201, 301) for preventing the corrosion of a contact includes the input terminal (11*x*, 12*x*, 13*x*), the input signal line (140), the low impedance section (141, 161), the high impedance section (142, 162, 248, 268, 348, 368), and the comparing section (143). The input signal line (140) is connected to the input terminal (11*x*, 12*x*, 13*x*), which is connected to the contact (120*a*, 130*a*) being outside the circuit. By means of the potential of the input signal line (140), a state of the contact (120*a*, 130*a*) can be determined. That is, when the contact (120*a*, 130*a*) is closed, a part, which is electrically connected due to the closed state, influences on the potential of the signal line (140). On the other hand, when the contact (120*a*, 130*a*) is opened, there is no such influence on the potential of the signal line (140). The low impedance section (141, 161) and the high impedance section (142, 162, 248, 268, 348, 368) are connected to the signal line (140). When the low impedance section (141, 161) is activated, the corrosion-prevention current for the contact (120*a*, 130*a*) is allowed to flow into the input terminal (11*x*, 12*x*, 13*x*). The comparing section (143) compares the potential of the input signal line (140) with the predetermined potential to judge the potential of the input signal line (140). Since the potential of the input signal line (140) connected to the contact (120*a*, 130*a*) is compared with the predetermined potential directly to judge whether or not the corrosion occurs, the proceeding state of the corrosion of the contact (120*a*, 130*a*) can be judged appropriately. Thus, effective measure for the corrosion prevention can be provided.

It is noted that not only the MOS transistor, but also other kinds of semiconductor elements such as a bipolar transistor may be used as the switching element 148, 168.

What is claimed is:

1. A circuit for preventing corrosion of a contact, the circuit comprising:

an input terminal adapted to be connected to a contact;

a signal line connected to the input terminal;

a switch connected to the signal line;

an impedance element connected to the signal line in parallel to the switch, an impedance of the switch being smaller than that of the impedance element; and a comparator that compares a potential of the signal line with a predetermined potential, wherein the switch is turned on based on a comparison result output from the comparator, and the predetermined potential corresponds to a fixed potential between a potential of the signal line when the contact is in a contact state and a potential of the signal line when the contact is in a non contact state.

2. The circuit according to claim 1, wherein:

the impedance element is a pull-up resistor connected to a power-source voltage side;

the contact is connected between the pull-up resistor and a ground side;

when the comparator detects that the potential of the signal line exceeds the predetermined potential, either (a) a contact resistance of the contact has increased due to corrosion of the contact or (b) the contact is disconnected from the ground side, and the switch is turned on; and when the switch is turned on, an impedance of a parallel circuit of the impedance element and the switch is reduced.

3. The circuit according to claim 1, wherein:

the impedance element and the switch are connected between a power source and the signal line; and when the potential of the signal line exceeds the predetermined potential, the comparator outputs the comparison result to turn on the switch.

4. The circuit according to claim 1, wherein:

the impedance element is a pull-down resistor connected to a ground side;

the contact is connected between the pull-down resistor and a power-source voltage side;

when the comparator detects that the potential at the signal line drops below the predetermined potential, either (a) a contact resistance of the contact has increased due to corrosion of the contact or (b) the contact is disconnected from the power-source voltage side, and the switch is turned on; and when the switch is turned on, an impedance of a parallel circuit of the impedance element and the switch is reduced.

5. The circuit according to claim 1, wherein:

the impedance element and the switch are connected between a ground and the signal line; and when the potential of the signal line is below the predetermined potential, the comparator outputs the comparison result to turn on the switch.

6. The circuit according to claim 3, further comprising:

a delay circuit disposed between the comparator and the switch, wherein:

the comparator outputs a logic value to the delay circuit, based on the comparison result; and after the delay circuit keeps receiving a same logic value for at least a predetermined time period, the delay circuit outputs the logic value to the switch.

7. The circuit according to claim 5, further comprising:

a delay circuit disposed between the comparator and the switch, wherein:

the comparator outputs a logic value to the delay circuit, based on the comparison result; and after the delay circuit keeps receiving a same logic value for at least a predetermined time period, the delay circuit outputs the logic value to the switch.

8. The circuit according to claim 1, wherein:

the impedance element includes a pull-up resistor connected to a power-source voltage side and a pull-down resistor connected to a ground side;

the contact includes at least one of a contact connected between the pull-up resistor and a ground side and a contact between the power-source voltage side and the pull-down resistor;

the comparator selects the predetermined potential from a first potential and a second potential;

when the comparator selects the first potential as the predetermined potential, the comparator judges whether or not a contact resistance of the contact increases due to corrosion of the contact when the contact is connected to the ground side and judges whether or not the contact is cut off from the ground side, by detecting whether or not the potential of the signal line exceeds the predetermined potential;

when the comparator selects the second potential as the predetermined potential, the comparator judges whether or not the contact resistance of the contact increases due to corrosion of the contact when the contact is connected to the power-source voltage side and judges whether or not the contact is cut off from the power-source voltage side, by detecting whether or not the potential of the signal line is reduced below the predetermined potential;

the switch includes a first switch and a second switch;

when the comparator selects the first potential as the predetermined potential and the first switch is turned on based on the comparison result, an impedance of a parallel circuit of the pull-up resistor and the first switch is reduced; and when the comparator selects the second potential as the predetermined potential and the second switch is turned on based on the comparison result, an impedance of a parallel circuit of the pull-down resistor and the second switch is reduced.

9. The circuit according to claim 1, wherein:

the impedance of the impedance element is selected from a plurality of impedances; and the predetermined potential is selected from a plurality of potentials.

10. The circuit according to claim 1, wherein one of an impedance of a semiconductor element and an impedance of a current source is used as the impedance element.

* * * * *